US006183152B1

(12) United States Patent
Kumai et al.

(10) Patent No.: US 6,183,152 B1
(45) Date of Patent: Feb. 6, 2001

(54) PRINTER WITH IMPROVED PAPER HANDLING MECHANISM

(75) Inventors: Eiji Kumai; Masatomo Kanamitsu; Tsuyoshi Tomii, all of Suwa (JP)

(73) Assignee: Seiko Epson Corporation, Tokyo (JP)

( * ) Notice: Under 35 U.S.C. 154(b), the term of this patent shall be extended for 0 days.

(21) Appl. No.: 09/224,392

(22) Filed: Dec. 31, 1998

(30) Foreign Application Priority Data

Jan. 5, 1998 (JP) ..... 10-12099
Sep. 4, 1998 (JP) ..... 10-250585

(51) Int. Cl.[7] ..... B41J 11/26

(52) U.S. Cl. ..... 400/611; 400/629; 101/222; 101/232

(58) Field of Search ..... 400/56, 611, 617, 400/618, 616, 616.2, 616.3, 629, 634; 101/225, 232

(56) References Cited

U.S. PATENT DOCUMENTS 5,000,591 * 3/1991 Burgess ..... 400/56
5,805,176 * 9/1998 Saito et al. ..... 400/56
5,940,092 * 8/1999 Kashimura et al. ..... 400/56
5,961,224 * 10/1999 Baitz et al. ..... 400/56

FOREIGN PATENT DOCUMENTS 6 311 4681 5/1988 (EP) .
0 209 9369 4/1990 (EP) .
0420400A2 * 4/1991 (EP) ..... 400/618
0 573 987 12/1993 (EP) .
0 713 2658 5/1995 (EP) .
0 676 296 10/1995 (EP) .
0 783 977 7/1997 (EP) .

* cited by examiner

*Primary Examiner*—Eugene Eickholt
(74) *Attorney, Agent, or Firm*—Stroock & Stroock & Lavan LLP

(57) ABSTRACT

A printer having a paper handling mechanism that includes a paper feed roller pair located upstream of a recording head. The paper feed roller pair includes a roller having a roller axis and a follow-up roller having a follow-up roller axis. A line between the roller axis and the follow-up axis is inclined towards the recording head. A paper discharge roller pair located downstream. The paper discharge roller pair includes a discharge roller having a discharge roller axis and a discharge follow-up rolling having discharge follow-up roller axis. A line between the discharge roller axis and the discharge follow-up roller axis is inclined towards the recording head.

11 Claims, 3 Drawing Sheets

PRINTER WITH IMPROVED PAPER HANDLING MECHANISM

BACKGROUND OF THE INVENTION

The present invention relates to a printer and, in particular, to a printer having a paper handling mechanism that reduces paper curling and improves print quality.

Generally, a serial printer operates by moving a recording head in the main scanning direction and feeding paper along a line in a direction perpendicular to the main scanning direction. A paper sheet is fed towards the recording head by a pair of paper feed rollers and is discharged into a stacker by a pair of paper discharge rollers located downstream from the recording head. As the trailing edge (bottom) of a paper is released from the pair of paper feed rollers, the trailing edge is raised towards the recording head as it approaches the nip portion of the pair of paper discharge rollers as a result of the force caused by the weight of the paper being discharged to the stacker. The result is that the size of a gap formed between the recording head and the paper is altered causing the print quality at the bottom of the paper to be adversely affected.

To overcome this problem, Japanese Unexamined Patent Publication No. Hei 7-132658 discloses a technique whereby the paper discharge rollers are inclined toward the recording head so that the trailing edge of the paper is prevented from rising as it is released from the paper feeding rollers.

Typically, in a paper feeding mechanism the rotational speed of the discharge rollers is slightly higher than that of the paper feed rollers so that tension is applied to the portion of the paper that extends between the paper discharge and paper feed rollers. As a result, if the discharge rollers are inclined toward the recording head, as described above, curling of the trailing edge of paper will occur when the tension applied to the paper is released as the trailing edge disengages from the paper feed rollers. Accordingly, it is desirable to provide a printer having a paper handling mechanism that reduces the curling of the paper while maintaining a constant gap size between the recording head and the paper.

SUMMARY OF THE INVENTION

The present invention is directed to overcoming the shortcomings of the prior art. The present invention is directed to a printer having a paper handling mechanism that includes a pair of paper feed rollers located upstream in the paper feeding direction with respect to the recording head. A pair of paper discharge rollers is located downstream of the recording head, which each pair of rollers being inclined toward a recording head. A platen is positioned between the paper feed rollers and the paper discharge rollers, wherein the platen, when viewed from upstream to downstream, includes a first flat face that is slightly lower than a nip portion of the paper feed rollers, a gradually upwardly rising sloped portion, a second flat face for forming a paper gap, a downward sloped portion and a third flat face that is lower than a nip portion of the paper discharge rollers.

Using a paper handling mechanism and platen formed in this manner, paper that is fed to the first flat face of the platen is fed in a direction away from the recording head by the paper feed rollers. Then, as the leading edge of the paper is advanced from the first flat face, it travels across the gradually upwardly rising sloped portion to the second flat face, where a paper gap is formed with the recording head, and then proceeds down across the downward sloped portion to the third flat face. In this way, curling of the leading edge of the paper is prevented. Also, because the trailing edge of the paper is fed in the direction away from the recording head by the paper discharge rollers, the curling of the trailing edge is also prevented. As a result, the print quality at the top and bottom of the paper is maintained.

Accordingly, it is an object of the present invention to provide a printer having a paper handling mechanism that can prevent the curling of the trailing and leading edges of a paper.

It is another object of the present invention to provide a printer having a paper handling mechanism that maintains a constant gap size between the recording head and the paper so that the print area at the top and bottom of the paper can be increased without diminishing the print quality.

Still other objects and advantages of the invention will in part be obvious and will in part be apparent from the specification.

The invention accordingly comprises the features of construction combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Referring to FIGS. 1–4, there is shown a paper handling mechanism 100 for an ink jet printer, constructed according to a first embodiment of the present invention. A platen 1 is located opposite a recording head 10. A paper feed roller pair 11, that includes a roller 11*a* and a follow-up roller 11*b*, is positioned on the side of platen 1 that is upstream with respect to the paper feeding direction, i.e., to the right in FIG. 1. Roller 11*b* is offset from roller 11*a* so that an imaginary line that connects the axes of roller 11*a* and follow-up roller 11*b* is inclined at an angle $\alpha$ toward recording head 10. $\alpha$ may be a small angle.

Figure 1:
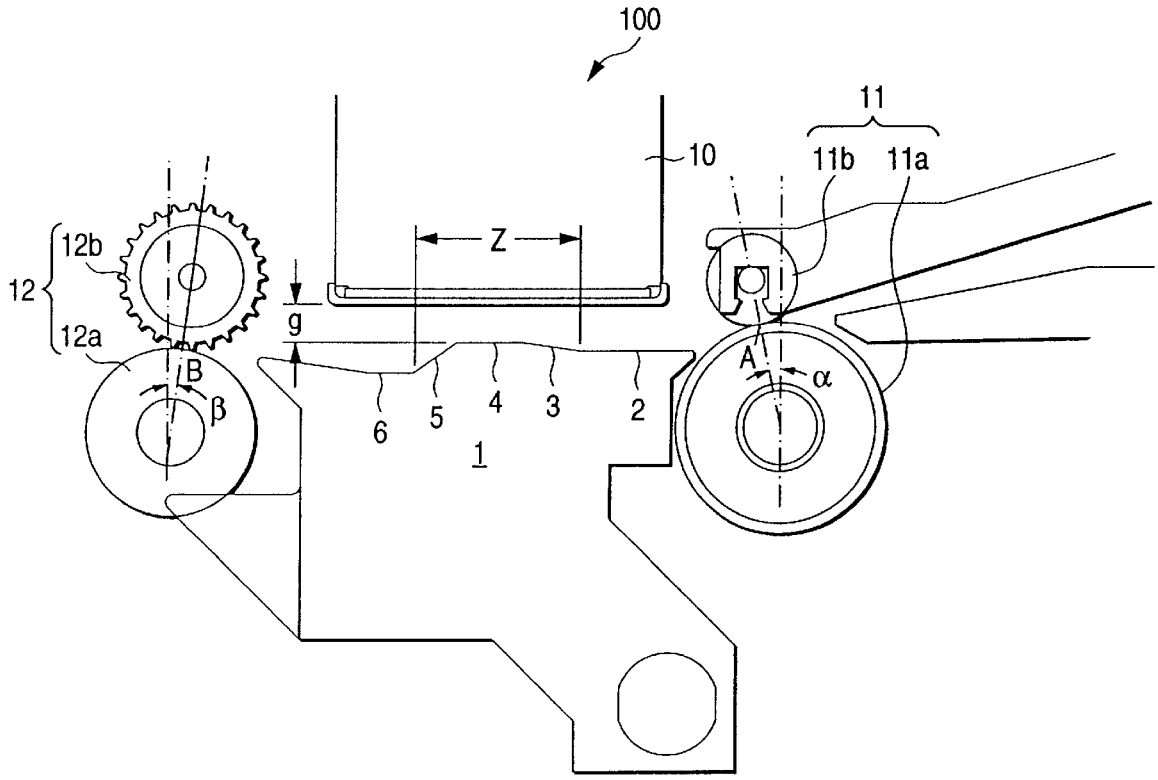
FIG. 1 is a side elevational view of the paper handling mechanism according to a first embodiment of the present invention.
Figure 2:
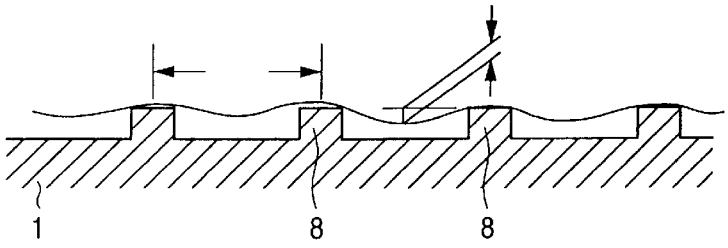
FIG. 2 is an enlarged cross-sectional view of the top face of a platen in accordance with the invention.

A paper discharge roller pair 12, that includes a roller 12*a* and a star wheel 12*b*, (which acts as a follow-up roller) is positioned downstream of platen 1, i.e., to the left in FIG. 1. Roller 12*b* is offset from roller 12*a* so that the imaginary line that connects the axes of roller 12*a* and star wheel 12*b* is inclined at an angle $\beta$ toward recording head 10. $\beta$ may also be a small angle.

The top face of platen 1 is formed so that, from the upstream to downstream direction, there is provided a first flat face 2, which is constructed slightly lower than a nip portion A formed between paper feed rollers 11*a,* 11*b,* to prevent the curling of the trailing edge of the paper S. Adjacent first flat face 2 is a gradually upwardly rising sloped portion 3 that is used for stabilizing the leading edge of the paper S. Adjacent gradually upwardly rising sloped portion 3 is a second short flat face 4 that, together with recording head 10, defines a predetermined paper gap g. Adjacent second short flat face 4 is a downward slope 5 that leads to a third flat face 6. Third flat face 6 is lower than a nip portion B formed between discharge rollers 12*a,* 12*b.* As described below, flat face 6 provides benefits in the situation when a thick paper is traversing mechanism 100.

The top face of platen 1 also includes a plurality of protrusions 8 spaced at intervals of 5 mm–15 mm and which extend into the paper feeding path in a direction that is substantially perpendicular to the paper feeding path. Protrusions 8 cause paper S to be raised to different heights (as measured from the portion of platen 1 located between protrusions 8) the heights ranging from 0.2 to 0.8 mm. The use of protrusions 8 in this manner imparts firmness to the paper, prevents the paper on the top face of the platen 1 from becoming wrinkled, and also guides the paper S in a line parallel to the bottom surface of recording head 10.

Figure 3:
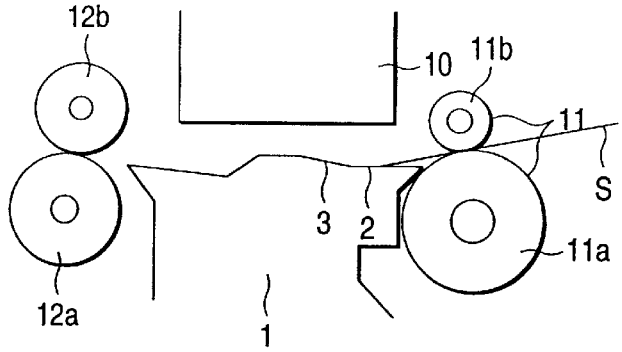
FIGS. 3(*a*)–(*d*) show different stages of the progression of a paper through the paper handling mechanism in accordance with the invention.
Figure 3:
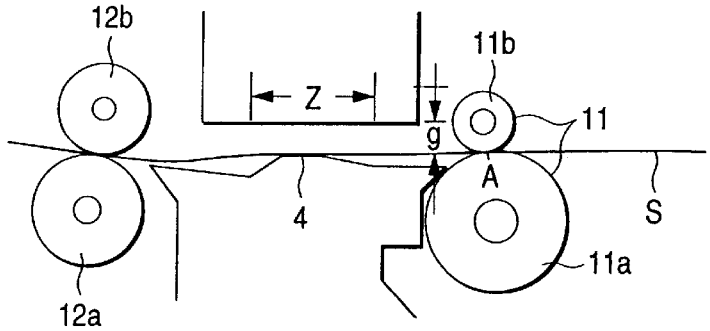
Figure 3:
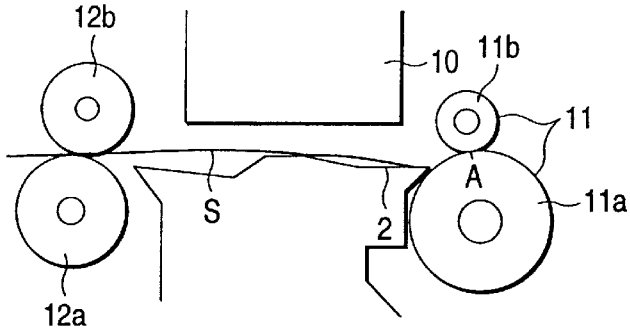
Figure 3:
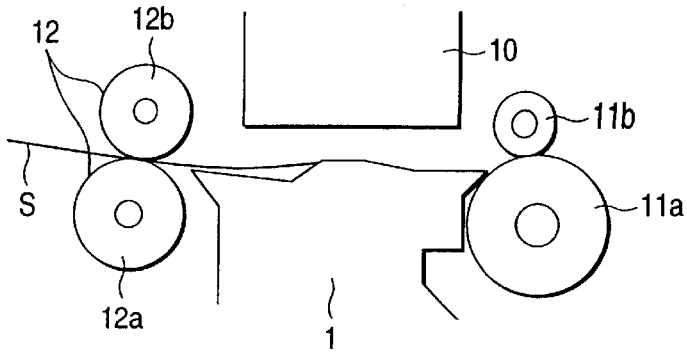

Referring to FIG. 3, the operation of mechanism 100 will now be described. Paper S is fed by paper feed roller pair 11 obliquely downward toward the top of platen 1. As shown in FIG. 3*a,* the leading edge of paper S lightly contacts first flat face 2, which is positioned slightly lower than nip portion A in order to prevent the curling of the trailing edge of paper S. Then, paper S, which is slightly curled in the opposite direction, is raised along the gradually upwardly sloped portion 3 which stabilizes the leading edge of paper S until paper S reaches second flat face 4. As is shown in FIG. 3*b,* a predetermined gap g is defined by the portion of paper S adjacent second flat face 4 and recording head 10 within a write zone Z of recording head 10. Also, protrusions 8 cause small waves to be formed on the face of paper S thereby impart a firmness to paper S which aids in guiding papers along recording head 10. While the leading edge of paper S is guided along recording head 10 in this manner, recording is performed on the top surface of the paper S.

Recording on paper S is continued while tension is applied to paper S by paper discharge roller 12*a,* which has a slightly higher circumferential speed than paper feed roller 11*a.* When the trailing edge of paper S is finally disengaged from nip portion A of paper feed roller pair 11, as is shown in FIG. 3*c,* the trailing edge of paper S smoothly descends from paper feed roller pair 11, to the first flat face 2, so as to prevent the curling of the trailing edge of paper S. Also, because paper discharge roller pair 12 is inclined toward recording head 10, the trailing edge of paper S is pressed down against the top face of platen 1 by paper discharge roller pair 12. Finally, after recording on one sheet of paper S is completed, paper S is discharged to a paper discharge tray (not shown).

Figure 4:
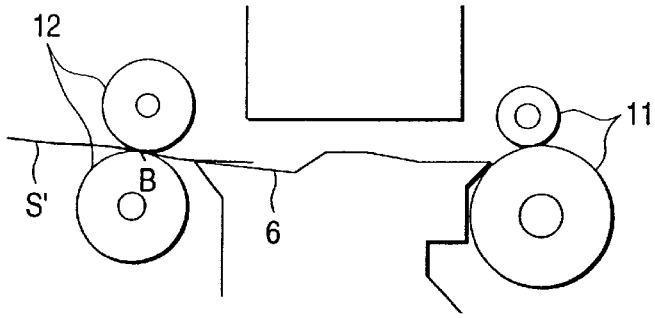
FIG. 4 shows a small, thick paper sheet being discharged from the paper handling mechanism in accordance with the invention.

Referring to FIG. 4, there is shown a small, thick sheet of paper S' being discharged out of mechanism 100. When the trailing edge of small, thick paper S' is disengaged from paper feed roller pair 11 and is fed only by paper discharge roller 12*a,* the trailing edge of small, thick paper S' drops down to third flat face 6. At that point, small, thick paper S' is positioned substantially parallel to an imaginary line that connects third flat face portion 6 and nip portion B of paper discharge roll pair 12. As a result, small, thick paper S' is easily fed through mechanism 100 even if paper discharge roller 12*a* provides only a small feeding force.

Figure 5:
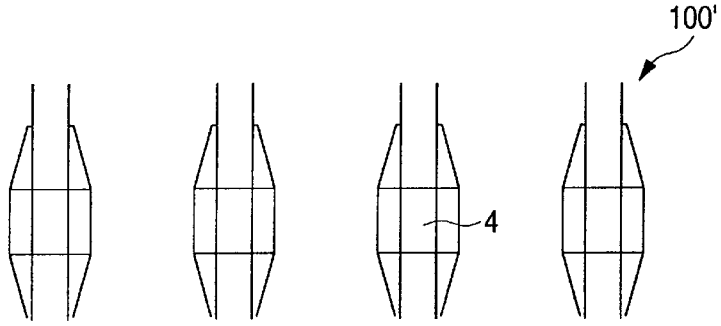
FIG. 5 is a top plan view of the paper discharge unit of a paper handling mechanism constructed in accordance with a second embodiment of the present invention.
Figure 5:
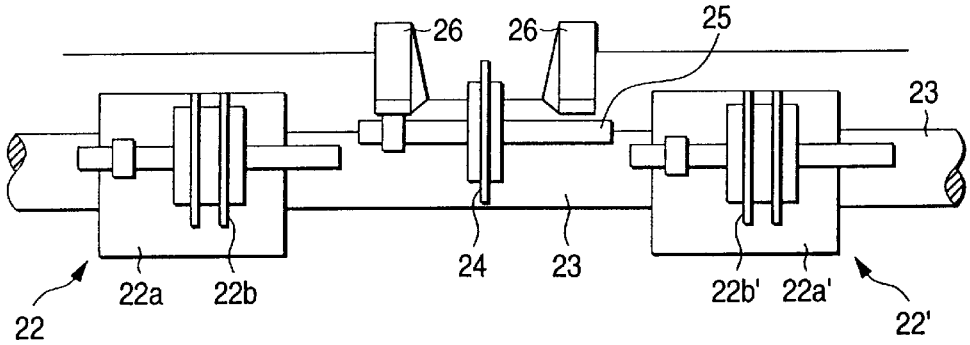
Figure 6:
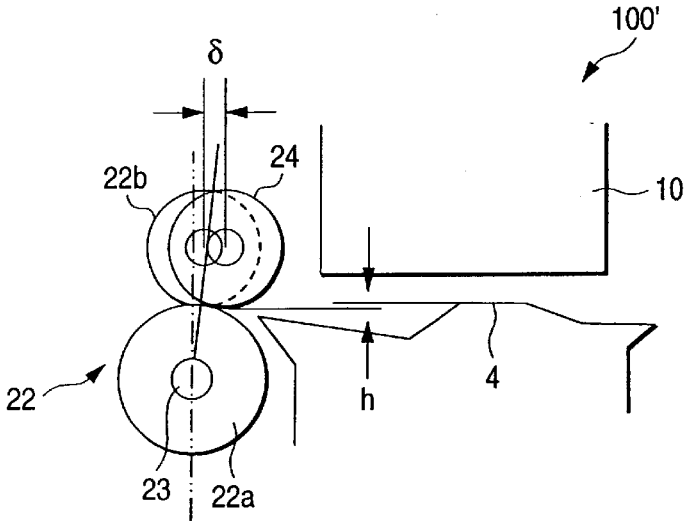
FIG. 6 is a side elevational view of the paper discharge unit of FIG. 5.

For certain specific sizes of paper S', the trailing edge of paper S', as it disengages from paper feed roller pair 11, may not be properly supported by platen 1 as a result of the inverted curling of paper S' caused by the discharge roller pair 12. Referring now to FIGS. 5 and 6, there is shown mechanism 100' according to a second embodiment of the present invention that prevents the curling of the trailing edge of paper S' of those specific sizes. Elements that are the same as corresponding elements in the first embodiment will be similarly labeled and a detailed description thereof will be omitted.

A pair of paper discharge roller pairs 22, 22' are located downstream of recording head 10. Each paper discharge roller pair 22, 22' includes a paper discharge roller 22*a,* 22*a',* respectively, which is fixed at an interval to a roller drive shaft 23, and a follow-up roller 22*b,* 22*b',* respectively. Each follow-up roller 22*b,* 22*b'* includes two star wheels that, as a result of the application of a weak force, are held in contact with and rotate with the corresponding paper discharge roller 22*a,* 22*a'.* As in the previous embodiment, each paper discharge roller 22*a,* 22*a'* and follow-up roller 22*b,* 22*b'* are arranged so that an imaginary line connecting their axes is inclined toward recording head 10.

Positioned between paper discharge roller pairs 22 and 22' is a curling prevention roller 24, which can be, for example, a single star wheel. Roller 24 is offset from follow-up rollers 22*b,* 22*b'* in the upstream direction by an interval δ (FIG. 6), where δ is preferably approximately 1.5 mm. Also, roller 24 is positioned so as to not contact recording head 10, and so that the lowermost edge of roller 24 reaches slightly lower than second flat face 4 by a distance h, where h is preferably approximately 0.6 mm. Curling prevention roller 24 is mounted on a shaft 25 that is supported by a bracket 26. According to this embodiment, after the trailing edge of thick paper S' is disengaged from paper feed roller pair 11, the trailing edge of thick paper S' is disengaged from paper feed roller pair 11, and the curling of the trailing edge of thick paper S' is prevented by roller 24.

When the trailing edge of thick paper S', which has been disengaged from the paper feed roller pair 11, is curled at the nip portion B of paper discharge rollers 22, 22', the weight of the portion of paper S' that has been discharged from the paper discharge rollers 22, 22' causes paper S' to be invertedly curled by paper discharge roller pairs 22, 22'. To prevent this curling, a downward pressing force is applied to paper S' by curling prevention roller 24. Thus, a constant gap between paper S' and recording head 10 is maintained and print quality at the trailing edge of paper S' is not adversely affected.

As described above, according to the present invention, printer paper handling mechanism 100 has paper feed rollers 11 located upstream with respect to the paper feeding direction, paper discharge rollers 12 located downstream, with both pairs of rollers being inclined toward recording head 10. Platen 1 is positioned between paper feed rollers 11 and paper discharge rollers 12, wherein platen 1, ranging from upstream to downstream, includes first flat face 2 that is slightly lower than nip portion A of paper feed rollers 11, gradually upwardly rising sloped portion 3, second flat face 4 for formation of a paper gap, downward sloped portion 5 and third flat face 6 that is lower than a nip portion B of paper discharge rollers 12. The leading edge of paper S is fed downward and advanced without the paper being curled, from first flat face 2 across gradually upwardly rising sloped portion 3 to second flat face 4 where recording is performed on paper S. Furthermore, because the trailing edge of paper S descends to the slightly lower, first flat face 2 after the paper is disengaged from paper feed rollers 11, any wobbling of the trailing edge of paper S is eliminated and any deterioration of the print quality occurring at the end portion of paper S is prevented.

Furthermore, curling prevention roller 24, is located between pair of paper discharge rollers 22, 22' and is offset in a direction upstream of pair of paper discharge rollers 22, 22'. In order to form a paper gap with recording head 10, roller 24 is positioned so that its lowermost edge is lower than second flat face 4. Therefore, even when the trailing edge of thick paper S', which has been disengaged from the paper feed roller pair, is curled due to the weight of the portion of paper S' that has been discharged to the stacker, a downward pressing force applied to paper S' by curling prevention roller 24 prevents the trailing edge of paper S' from rising higher than second flat face 4. As a result, a constant gap at recording head 10 can be maintained, and the quality of printing at the end of the trailing edge of paper S' is not diminished.

Furthermore, on platen 1 adjacent paper discharge roller pair, third flat face 6 is formed in a manner so that it is lower than nip portion B of paper discharge roller pair 12. Thus, when printing small, thick paper S', such as a postcard, because the trailing edge descends to third flat face 6, paper S' can be horizontally inserted between paper discharge rollers 12 that are inclined toward recording head 10. As a result, paper S' can be properly discharged even if paper discharge roller pair 12 provides a small discharging force.

As can be seen at the object set forth above, those apparent from the preceding description, are efficiently attained and, because certain changes may be made in the above construction without departing from the spirit and scope of the invention, it is intended that all matter contained in the above description are shown in the accompanying drawings shall be interpreted as illustrative and not in a limiting sense.

It is also to be understood that the following claims are intended to cover all the generic and specific features of the invention herein described, and all statements of the scope of the invention, which as matter of language, might be said to fall therebetween.

What is claimed is:

1. A printer having a recording head, comprising:

a paper feed roller pair disposed upstream of said recording head, said paper feed roller pair including a drive roller having a roller axis and a follow-up roller having a follow-up axis, a line intersecting both said roller axis and said follow-up axis being inclined towards said recording head, wherein said follow-up roller is located closer to said recording head than said drive roller;

a paper discharge roller pair disposed downstream of said recording head, said paper discharge roller pair including a discharge drive roller having a discharge roller axis and a discharge follow-up roller having a discharge follow-up roller axis, a line intersecting both said discharge roller axis and discharge follow-up roller axis being inclined towards said recording head, wherein said discharge follow-up roller is located closer to said recording head than said discharge drive roller; and a platen, said platen being disposed between said paper feed roller pair and said paper discharge roller pair, said platen being substantially parallel to said recording head.

2. The printer of claim 1, wherein a first nip portion is formed between said roller and follow-up roller, a second nip portion is formed between the discharge roller and follow-up discharge roller, said platen has a first flat face that is adjacent to and lower than said first nip portion; an upwardly rising slope portion adjacent said first flat face; a second flat face disposed across a paper gap from said recording head adjacent said upwardly rising slope portion; a downwardly descending slope portion adjacent said second flat face; and a third flat face that is lower than said second nip portion, and disposed between said second nip portion and said downwardly descending slope portion.

3. The printer according to claim 2, further comprising a second paper discharge roller pair axially aligned with said paper discharge roller pair; a curling prevention roller disposed between said paper discharge roller pair and said second paper discharge roller pair and offset in a paper feed direction from said paper discharge rollers.

4. The printer according to claim 3, wherein said curling prevention roller has a lowermost edge, said roller being positioned so that said lowermost edge is lower than said second flat face.

5. The printer according to claim 2, wherein a plurality of protrusions are disposed on said platen extending towards said recording head, said plurality of protrusions disposed on said platen at intervals in a range from 5 to 15 mm.

6. The printer according to claim 3, wherein said curling prevention roller is a star wheel.

7. A printer having a recording head, comprising:

a paper feed roller pair disposed upstream of said recording head, said paper feed roller pair including a roller having a roller axis and a follow-up roller having a follow-up axis, a line intersecting both said roller axis and said follow-up axis being inclined towards said recording head;

a paper discharge roller pair disposed downstream of said recording head, said paper discharge roller pair including a discharge roller having a discharge roller axis and a discharge follow-up roller having a discharge follow-up roller axis, a line intersecting both said discharge roller axis and discharge follow-up roller axis being inclined towards said recording head; and a platen, said platen being disposed between said paper feed roller pair and said paper discharge roller pair, said platen being substantially parallel to said recording head, wherein a first nip portion is formed between said roller and follow-up roller, a second nip portion is formed between the discharge roller and follow-up discharge roller, said platen has a first flat face that is adjacent to and lower than said first nip portion; an upwardly rising slope portion adjacent said first flat face; a second flat face disposed across a paper gap from said recording head adjacent said upwardly rising slope portion; a downwardly descending slope portion adjacent said second flat face; and a third flat face that is lower than said second nip portion, and disposed between said second nip portion and said downwardly descending slope portion.

8. The printer according to claim 7, further comprising a second paper discharge roller pair axially aligned with said paper discharge roller pair; a curling prevention roller disposed between said paper discharge roller pair and said second paper discharge roller pair and offset in a paper feed direction from said paper discharge rollers.

9. The printer according to claim 8, wherein said curling prevention roller has a lowermost edge, said roller being positioned so that said lowermost edge is lower than said second flat face.

10. The printer according to claim 7, wherein a plurality of protrusions are disposed on said platen extending towards said recording head, said plurality of protrusions disposed on said platen at intervals in a range from 5 to 15 mm.

11. The printer according to claim 8, wherein said curling prevention roller is a star wheel.

* * * * *